US010272277B2

(12) United States Patent
Heath

(10) Patent No.: US 10,272,277 B2
(45) Date of Patent: Apr. 30, 2019

(54) APPARATUS, SYSTEM AND METHOD FOR EXTINGUISHING A FIRE OVER THE REAR AXLE OF A TRUCK TRAILER

(71) Applicant: HLS Industries LLC, Little Rock, AR (US)

(72) Inventor: Jason Heath, Conway, AR (US)

(73) Assignee: HLS Industries, LLC, Little Rock, AR (US)

( * ) Notice: Subject to any disclaimer, the term of this patent is extended or adjusted under 35 U.S.C. 154(b) by 0 days.

(21) Appl. No.: 15/165,874

(22) Filed: May 26, 2016

(65) Prior Publication Data

US 2017/0340908 A1 Nov. 30, 2017

(51) Int. Cl.

| | |
|---|---|
| ***A62C 3/07*** | (2006.01) |
| ***A62C 37/44*** | (2006.01) |
| *A62C 35/11* | (2006.01) |

(52) U.S. Cl.

CPC ..... *A62C 3/07* (2013.01); *A62C 37/44* (2013.01); *A62C 35/11* (2013.01)

(58) Field of Classification Search

CPC ..... A62C 3/07; A62C 37/44; A62C 27/00; A62C 35/00–35/20

USPC ..... 169/62, 56–61

See application file for complete search history.

(56) References Cited

U.S. PATENT DOCUMENTS

| | | | | | |
|---|---|---|---|---|---|
| RE24,869 | E * | 9/1960 | Donehue | A62C 3/07 | 134/123 |
| 3,594,752 | A * | 7/1971 | Alton | F25D 29/008 | 338/22 R |
| 3,993,138 | A * | 11/1976 | Stevens | A62C 37/50 | 169/61 |
| 4,091,876 | A * | 5/1978 | Valdatta | A62C 3/07 | 169/11 |
| 5,959,365 | A * | 9/1999 | Mantini | B60C 23/0408 | 180/197 |
| 2006/0278412 | A1* | 12/2006 | Hodges | A62C 3/07 | 169/60 |
| 2007/0235268 | A1* | 10/2007 | Caron | B60T 17/221 | 188/71.8 |

* cited by examiner

*Primary Examiner* — Alexander M Valvis
*Assistant Examiner* — Tuongminh N Pham

(57) ABSTRACT

An apparatus, system and method have a sensor positioned above a rear axle attached to a brake of a trailer. The sensor detects whether the temperature of the brake exceeds a threshold temperature. A light is mounted on the trailer and activates in response to the temperature of the brake exceeding the threshold temperature. A handle is pulled to distribute a fluid on the rear axle of the trailer. A conduit extends across the underside of the trailer wherein the conduit carries the fluid. A nozzle sprays the fluid over the rear axle.

10 Claims, 5 Drawing Sheets

APPARATUS, SYSTEM AND METHOD FOR EXTINGUISHING A FIRE OVER THE REAR AXLE OF A TRUCK TRAILER

BACKGROUND OF THE INVENTION

The present invention generally relates to an apparatus, system and a method for extinguishing a fire at a rear axle of a trailer of a truck. More specifically, the present invention relates to integrated systems to detect brake failure to provide notice to a truck driver of who may then activate spraying a fire extinguishing agent at the affected areas of the trailer.

Trucks, especially semi-trucks with one or more trailers, are essential to shipment of goods that may be transported, such as from a manufacturing facility or coastal port to an intermediate processing center or to a final merchandise distributor, such as a retail store. Further, the trucking industry may provide additional flexibility not otherwise available by rail and/or water vessel shipment, such as the ability to reach remote inland destinations not connected to major railways and/or rivers. Trucks may travel at any hour of the night and/or day to provide shipment within predictable time frames.

In view of the advantages of shipping goods via trucks, truck drivers have responded to increased demand for trucking services by driving longer hours over various types of terrain, including mountainous terrain. Traveling downhill may require frequent usage of the brakes on both the truck and the one or more trailers connected to the truck. Typically, air brakes are used for heavy vehicles, such as trucks, truck trailers and/or buses. An air brake, when used with a disc brake assembly, releases compressed air to move pistons of a brake caliper to apply pressure to a brake pad which stops the vehicle upon contact with the rotating brake rotor. Air brakes may be compatible with drum brakes and function by forcing drum brake shoes and/or pads to contact against the rotating cylinder part of a brake drum. In either set-up, i.e., an air brake used with a disc brake or a drum brake, excessive and/or heavy usage of the air brake mechanism may deteriorate the same allowing for the brakes to adhere in a fixed or "stuck" position. The resultant friction between the various parts of the stuck brakes and/or stuck bearings, such as a wheel bearing, may result in a fire erupting from the stuck brakes and/or bearings that may spread across the entire rear axle of the trailer.

Known methods, apparatuses or systems for extinguishing a fire resulting from stuck brakes may not notify the driver of the fire via an alarm condition allowing the driver to systematically address and/or extinguish the fire. Thus, a need exists for a system that may detect the breakout of a fire over the rear axle of a trailer and provide the driver with extinguishing capability to contain and/or extinguish the fire.

SUMMARY OF THE INVENTION

The present invention generally relates to an apparatus, a system and a method for extinguishing a fire at a rear axle of a trailer of a truck. More specifically, the present invention relates to integrated systems to detect brake failure to provide notice to a truck driver of who may then activate spraying a fire extinguishing agent at the affected areas of the trailer.

The invention provides an apparatus having a sensor positioned above a rear axle attached to a brake of a trailer. The sensor detects whether the temperature of the brake exceeds a threshold temperature. A light is mounted on the trailer and activates in response to the temperature of the brake exceeding the threshold temperature. A handle is mounted on the side of the trailer. Pulling the handle distributes a fluid on the rear axle of the trailer. A bottle houses the fluid and attaches to the trailer. A conduit extends substantially across the side of the trailer wherein the conduit carries the fluid. A nozzle sprays the fluid over the rear axle. A wireless temperature monitoring system detects whether the temperature of the brake exceeds the threshold temperature.

Additionally, the invention provides a system having a wireless temperature monitoring device that monitors temperature fluctuation of brakes on a trailer. The wireless temperature monitoring system is programmed with a preset temperature lower than an ignition temperature of the brake. A light activated in response to temperature fluctuation of the brake detected by the wireless temperature monitoring device. A fire extinguishing device discharges fluid stored in a bottle through a conduit to spray the fluid over an axle affected by fire.

Further, the invention provides a method for monitoring whether a temperature of a brake exceeds a threshold. An alarm may be triggered upon the temperature of the brake exceeding the threshold. The alarm may be communicated to the driver of a trailer. A fluid may be discharged over the brake in response to input from the driver. A bottle may house the fluid. The bottle may attach to the trailer. A conduit carrying the fluid may extend substantially across the side of the trailer. A nozzle may spray the fluid over the rear axle.

Accordingly, it is an advantage of the present invention to provide an apparatus, a system and a method for extinguishing a fire at a rear axle of a trailer of a truck.

Another advantage of the present invention is to provide a wireless temperature monitoring system that may detect whether the temperature of the brake exceeds the threshold temperature.

Yet another advantage of the present invention is to provide a fire extinguishing system that sprays the fluid over the rear axle.

Still another advantage of the present invention is to provide a rear-view mirror mounted on the tractor with the wireless temperature monitoring device wherein the rear-view mirror permits for viewing of a light indicative of a temperature fluctuation of the brake.

A further advantage of the present invention is to provide a nozzle that sprays the fluid across distribution areas to extinguish the fire.

A still further advantage of the present invention is to provide an alert notification sent to a remote device, such as a cell phone.

A still further advantage of the present invention is to spray the fluid over the rear axle of the trailer to partially extinguish the fire.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

In the following description, numerous details are set forth to provide an understanding of the present invention. Further, numerous variations or modifications from the described embodiments may be possible.

Figure 1:
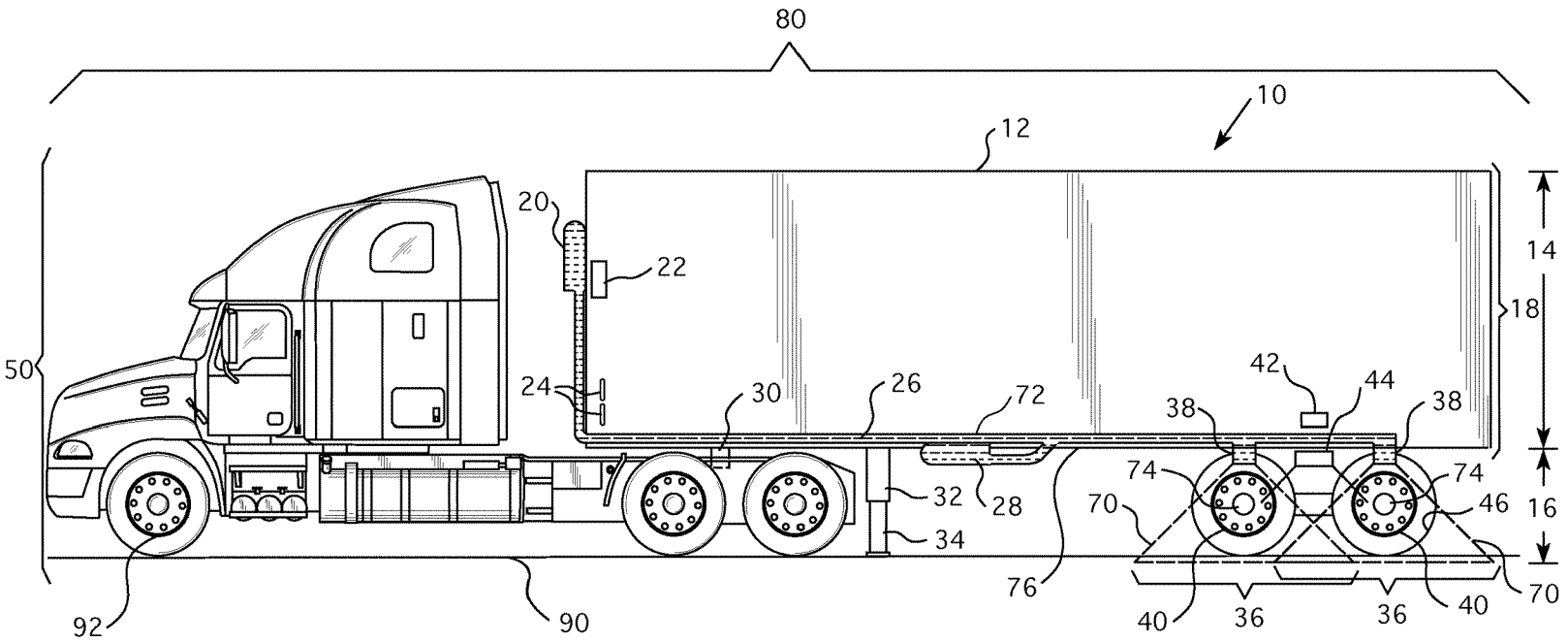
FIG. 1 illustrates a side view of a truck with an attached trailer in accordance with an embodiment of the invention.

Referring to FIG. 1, a trailer 10 is shown attached to a tractor 50 by a pin 30 extending toward the tractor 50 from the trailer 10. The tractor 50 may refer to the front of a "tractor-trailer" type truck, i.e. where the tractor 50 may house an engine, etc. The tractor 50 attached to the trailer 10 by the pin 30 may be collectively referred to as a truck 80. In an embodiment, the trailer 10 may be substantially rectangular and may be defined by a top surface 12 extending longitudinally from the tractor 50 toward a rear 18. One of ordinary skill in the art will appreciate that other types, variations, orientations and/or dimensions of trailers may attach to and/or be used in combination with the tractor 10. For instance, FIG. 4 shows a perspective view of an oil tanker which may be a type of trailer 10 that may be pulled by the tractor 50.

In an embodiment, the trailer 10 may have a height 18 at a distance 16 from a ground 90. The distance 16 may be adjusted to meet regulations set forth by state and/or national governments and/or to accommodate specific types of cargo that may be contained within the trailer 10.

A bottle 20 may be attached to the trailer 10 that may enclose a fluid 26 within a conduit 72, as shown in FIG. 1. The conduit 72 may extend from the bottle 20 toward a discharge nozzle 38 that may be positioned generally above a rear axle 74 of the trailer 10. In an embodiment, the fluid 26 held within the bottle 20 may be an extinguishing agent that may be synthesized from a chemical. In an embodiment, the extinguishing agent may be a pressurized liquid and/or a suspension of liquid droplets in vapor and/or a gaseous mixture. Alternatively, a multipurpose dry chemical mixture of substantially monoammonium phosphate may be suspended in a pressurized gaseous mixture and stored in the extinguishing agent bottles. Such potential fire extinguishing agents are intended to be exemplary and non-exhaustive. One of ordinary skill in the art will appreciate that other suitable types and/or forms of fire extinguishing agents may exist and may be stored in the bottle 20.

Figure 3:
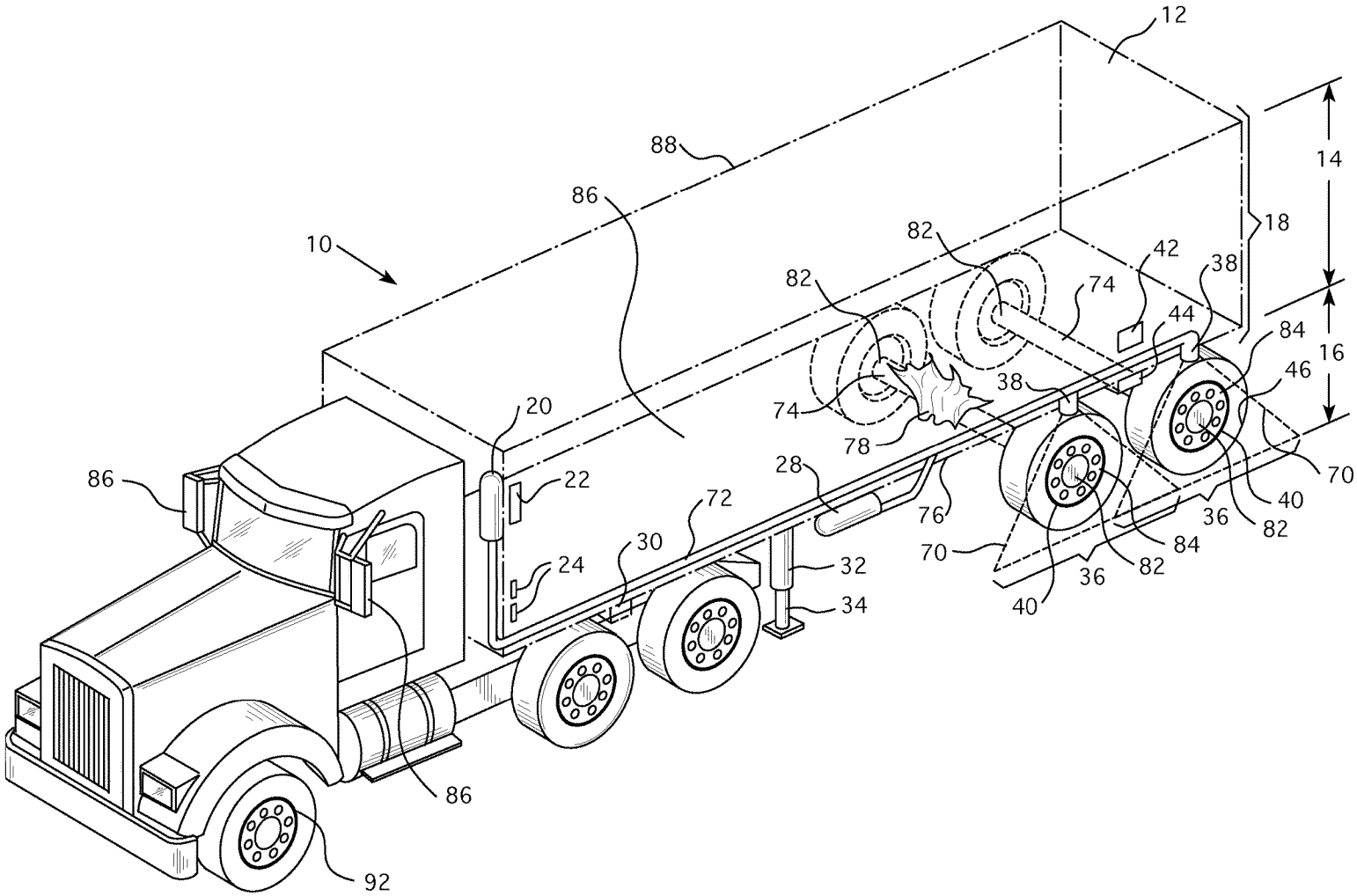
FIG. 3 illustrates a perspective view of a truck in accordance with an embodiment of the invention.
Figure 4:
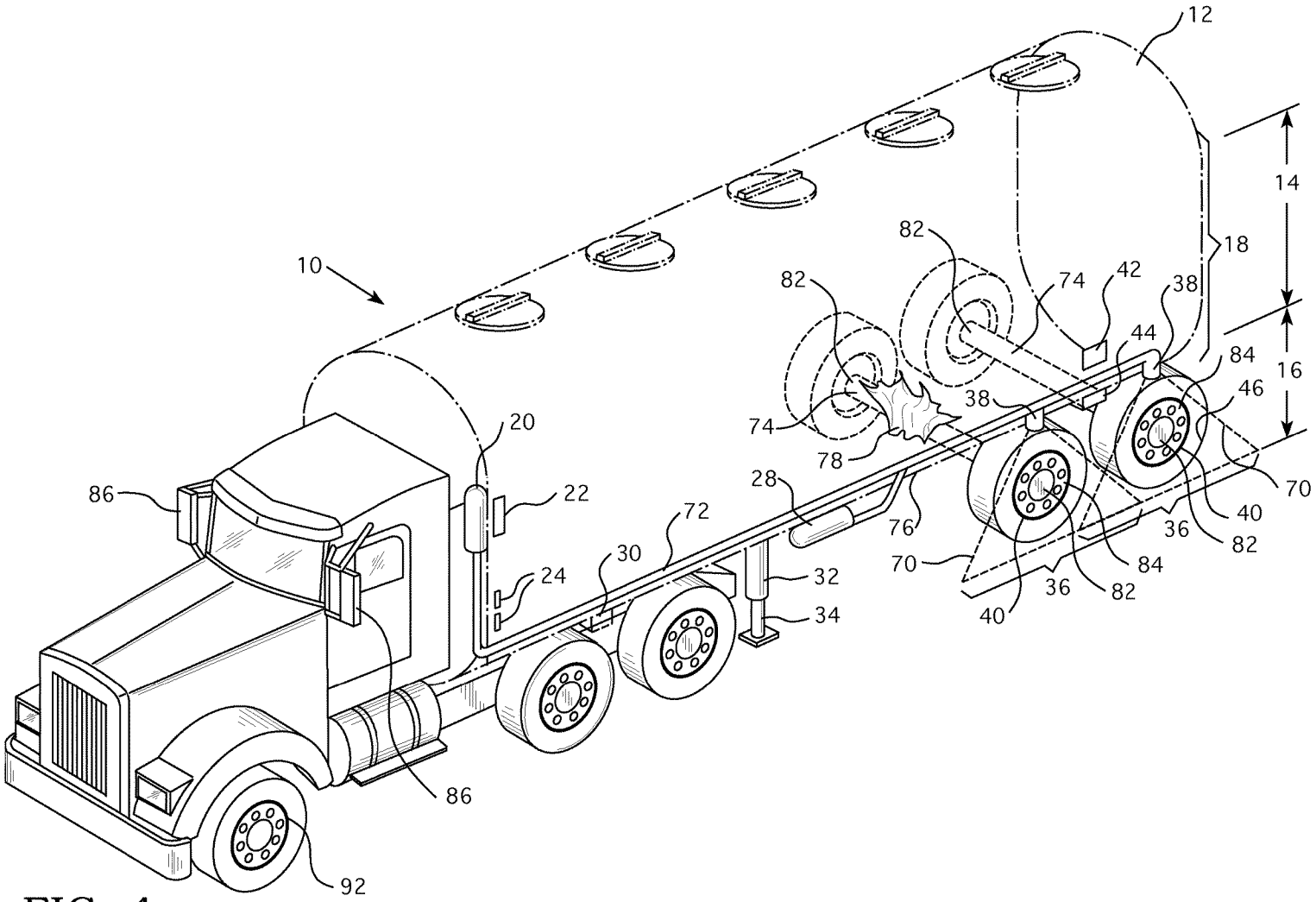
FIG. 4 illustrates a perspective view of an oil tanker in accordance with an embodiment of the invention.

A brake 40 may be installed at an end 82, as shown in FIGS. 3 and 4, of the rear axle 74 to slow and/or stop rotation of a tire 46 during operation of the tractor 50 pulling the trailer 10. In an embodiment, the brake 40 may be a disc brake that operates by moving pistons in a caliper of the brake 40 to compress a brake pad against a rotating brake rotor. Friction between the brake pad and the rotor may slow rotation of the tire 46. For instance, the tire 46 may be generally installed around a wheel 84, as shown in FIGS. 3 and 4, the brake 40. Accordingly, operation of the brake 40 may slow rotation of the rear axle 74 and produce a commensurate slowdown in rotation of the wheel 84. The reduction in rotation of the tire 46, that may be installed and/or otherwise wrapped around the wheel 84, may thus slow down the trailer 10.

A fire 78, as shown in, for example, FIGS. 3 and 4, may be caused by increased temperature conditions attributable to brake failure due to excessive use during trucking operations. Generally, in disc brake operations, the failed brake 40 may "freeze" and/or become stuck in a locked position. Specifically, a caliper, i.e. an assembly which houses brake pads and pistons which compress the brake pads against a rotating rotor, of the brake 40 may fail. Failure of the caliper may result in the pistons fully compressing a pad against a rotor of the brake 40 to cease movement of the tire 46 around, for example, a rear axle 74 of the trailer 10. The remaining brakes 40, i.e. operational brakes unaffected by fire, may continue to allow unfrozen wheels to rotate freely. Friction caused by the "stuck" and/or failed brake 40 may result in heat developing at the brake and/or across the rear axle 74, where such heat may contribute to ignition of the fire 78, which may burn the brake 40, the tire 46 and/or the rear axle 74.

Further, the stuck brake 40 may cause the tire 46 associated with the stuck brake 40 to drag along a pavement 90, as shown in FIG. 1, and/or a road surface. The dragging tire 46 may cause heat to develop in the contact region between the tire 46 and the road surface to thus give rise to combustion conditions that may cause the fire 78 to ignite, burning the brake 40, the tire 46 and/or the rear axle 74.

The stuck brake 40 may cause the tire 46 to drag against the pavement 90, as shown in FIG. 1, with which the tire 46 contacts. Accordingly, rubber of the tire 46 may increase in temperature and potentially ignite to cause the fire 78. Any of the brake 40, the tire 46 and/or the rear axle 74 may be burnt by the fire 78, thus presenting a substantial safety hazard to the driver and/or passers-by from the continued operation of the tractor 50 and/or the trailer 10.

Alternatively, the brake 40 may be a drum brake with a shoe that expands to compress against a drum. The drum brake may be generally installed within a wheel and/or a wheel well. Failure of the drum brake may cause the shoe to freeze and/or become stuck. Specifically, the shoe may fail in a fixed position compressed against the rotating drum. Friction between the shoe and the rotating drum may increase the temperature of the drum brake thus making the drum brake particularly susceptible to ignite in fire. In addition, the failed drum brake may cause the wheel around the failed drum brake to lock in place, thus dragging the tire of that wheel along the pavement 90. For example, friction resulting from the tire 40 dragging along the pavement 90 may cause increased temperature conditions ideal for ignition of the fire 78 over the rear axle 74.

The brake 40, either as a disc brake or as a drum brake, may be supported in operation by compressed air delivered through hoses attached to and in fluid communication with various disc brake and/or drum brake parts. A compressed air delivery assembly may be referred to as an air brake, i.e., a type of brake that may be used to stop heavy vehicles, such as trucks and/or buses. Similar situations suitable for ignition for the fire 78 may arise due to the failure of drum brakes that may cause the brakes to fail and/or lock in a fixed position and/or ignite.

The fire 78 that may spread over both the brakes 40 and the tires 46 may present a safety hazard for continued operation of the tractor 50 with the trailer 10, as well spread to nearby motorists and/or pedestrians. A wireless temperature monitor 44, as shown in FIGS. 1, 3 and 4 may electronically communicate with a system 100 that includes a wireless temperature monitoring system 102 (herein "WTMS 102") and a fire extinguishing system 112 (herein "FES 112").

A side light 42 may be mounted and/or attached to the trailer 10 above the wireless temperature monitor 44. The side light 42 may be activated in response to an elevated temperature condition of any one or more of the brakes 40, the tire 46 and/or the rear axle 74 to alert the driver of the tractor 50 of the potential for the fire 78 to spread across the rear axle 74. Further, in an embodiment, the WTMS 102 may monitor temperature fluctuation of front brakes 92 of the tractor 50 pulling the trailer to alert the driver of an increased temperature condition.

Figure 2:
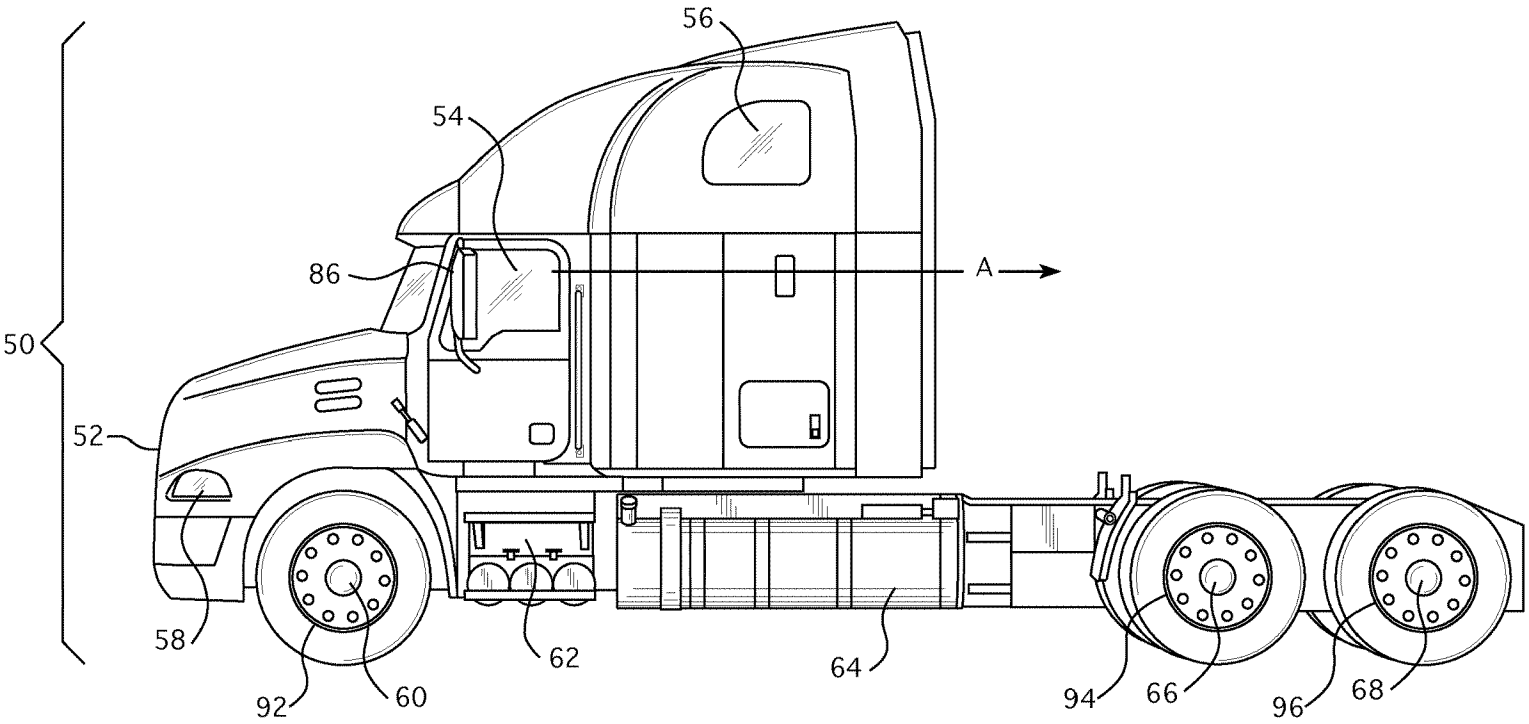
FIG. 2 illustrates a side view of a truck in accordance with an embodiment of the invention.

The WTMS 102 may monitor temperature fluctuation of the brakes 40 of one or more rear axles 74 on the trailer 10, of the front brakes 92, a first set of tractor brakes 94 and/or a second set of tractor brakes 96, as shown in FIG. 2, of the tractor 50. The WTMS 102 may be programmed to communicate an alarm condition to the driver of the trailer 10, such as by activating one or more of the light 22 and/or the side light 42, when the temperature detected by the wireless temperature monitor 44 of the brake 40, the brake 92, bearing grease and/or the tire 46 exceeds a pre-set temperature. In an embodiment, the pre-set temperature may be lower than an ignition temperature of the brake 40, bearing grease and/or the tire 46. Thus, if the brake 40 may be fixed in a closed position, i.e. being stuck and/or dragging, the WTMS 102 may detect the temperature of the brake 40 increasing to approach the pre-set temperature to, for example, activate one or more of the light 22 and/or the side light 42.

The light 22 may activate in response to temperature fluctuation that may be detected by the wireless temperature monitor 44 of the brake 40, bearing grease and/or the tire 46. For instance, the light 22 may be mounted within a line of sight in a direction A in FIG. 3. Thus, the driver of the tractor 50 may view activation of the light 22 in the rear-view mirrors 86 mounted on sides of the tractor 50, as shown in FIG. 1 and FIGS. 3 and 4. Accordingly, the light 22 may visually alert a driver of the tractor 50 that may be towing the attached trailer 10 to a fire 78. Specifically, the fire 78 may spread over the rear axle 74 of the trailer 10 due to sticking and/or dragging of the brakes 40. In an embodiment, the light 22 may be referred to as an over-heat warning light.

To address the ignition and/or spreading of the fire 78, the bottle 20 may be in fluid communication with the nozzle 38 via the conduit 72 that may be mounted on an underside 76 of the trailer 10. The nozzle 38 may spray the fluid 26 across distribution areas 36 on both a left side 88 and a right side 86 of the trailer 10, as shown in FIG. 3, to extinguish the fire 78. An angle 70 of the distribution areas 36 may be adjusted to extend or to shorten the distribution areas 36. Further, in an embodiment, the nozzle 38 may be positioned at and/or near to the front wheel 92 on the tractor 50, first set of wheels 66 followed by a second set of wheels 68. Accordingly, the nozzle 38 may spray the fluid 26 to contain and/or extinguish the fire 78 breaking out over any one or more of the front brake 92, the first set of tractor brakes 94 and/or the second set of tractor brakes 96, as shown in FIG. 2, of the tractor 50.

In an embodiment, an alert notification may be electronically sent to a device via, for example, a program and/or application on the device. Specifically, the alert notification may be sent to a cell phone, for example, of a driver of the trailer 10. The alert notification may be sent through a satellite system operated by, for example, a central dispatch center, to the owner and/or driver of the truck. This communication may allow a trucking company to send an alert to a driver to inform the driver of potential issues with the brake 40 and/or the tire 46 of the trailer as problems develop. Such preemptive notification of problem situations may allow the driver to safely position the tractor 50. Moreover, if the brake 40 has already caught the fire 78, the FES 112 may be used to extinguish the fire 78.

Activation handles 24 that may be located on a side of the trailer 10 near the tractor 50 may be pulled by the driver of the truck 50 in response to viewing of the light 22, which may be activated in response to increased temperatures detected by the WTMS 102. In an embodiment, the activation handles 24 may be shaped as a "T" and referred to as "T-shaped" activation handles 24.

The driver of the tractor 50 may activate the FES 112 by pulling the activation handles 24 to discharge the fluid 26 that may be stored in the bottle 20 through the conduit 72. The fluid 26 may fill the conduit 72 as shown in FIG. 1, for example, to flow toward the nozzle 38, which may spray the fluid 26 to the rear axle 74 affected by the fire 78. Upon activation of the FES 112 by the driver of the tractor 50, the nozzle 38 may spray the extinguishing agent onto and/or over the stuck brake 40 and/or tire 46 to, for example, partially extinguish or at least contain the fire.

In an embodiment, the driver of the tractor 50 may activate the FES 112 by pulling activation handles 24 to discharge the fluid 26 to flow generally toward the nozzle 38, which may be mounted on the tractor 50 near the front brake 92. The nozzle, near the front brake 92, may spray the fluid 26 to cool and/or otherwise lower the temperature of the front brake 92. Further, spraying the fluid 26 over and/or toward the front brake 92 may contain and/or extinguish the fire 78 which may spread over the front brake 92.

In an embodiment, operation of the FES 112 may primarily contain the fire 78 until the fire department may arrive at the trailer 10 to extinguish the fire 78. The activation handles 24 may be manually operated by pulling the activation handles 24 by the driver of the tractor 50 when a fire centered over the rear axle 74 may be detected by the WTMS 102 and communicated to the driver via the activated light 22.

The driver of the tractor 50 may pull one of the activation handles 24 which, in turn, may spray an initial discharge of the fluid 26 over the distribution areas 36 of the trailer 10 affected by fire, such as the brakes 40, the tires 46 and/or the rear axle 74. The initial release of the fluid 26 may suppress the fire. Application of the fluid 26 over the fire-affected regions of the trailer may protect the trailer 10 and/or cargo held by the trailer 10 until the fire department arrives to extinguish the fire.

Sticking, dragging and/or stuck brakes may potentially re-ignite due to residual heat stored in the brakes 40, even after the initial application of the fluid 26. In a circumstance where the brakes 40 re-ignite, the driver of the tractor 50 may pull another one of the activation handles 24 to initiate discharge of the fluid 26 a second time. The second discharge subsequent to the initial discharge may prevent further spreading of fire to the trailer 10 and/or cargo inside the trailer 10. The nozzle 38 may spray the fluid 26 for a second time over and/or across the distribution areas 36 on the left side 88 and/or the right side 86 of the trailer 10 to suppress the fire.

In an embodiment, the bottle 20 may be relocated to an alternative location 28 for the fluid 26 on the underside of the trailer 10. Further, in an embodiment, an supplementary bottle 28 may be installed at the underside 72 of the trailer 10 in front of the tire 46. The supplementary bottle 28 may either replace and/or supplement the bottle 20 to assist in operation of the FES 112 to suppress fire over the rear axle 74 of the trailer 10 as detected by the WTMS 102. A piston 32 may extend a support post 34 toward the ground to support the trailer 10 in a parked position while the truck 10 is parked to, for example, activate the FES 112 in response to the WTMS 102 to treat fire breaking out over the rear axle 74 of the trailer 10. The driver of the tractor 50 may extend the piston 32 to move the support post 34 toward the ground to support the trailer 10 while the tractor 50 may be parked. The pin 30 may extend from the underside 76 of the trailer 10 to connect with the tractor 50 to attach the trailer 10 to the tractor 50.

In an embodiment, the conduit 72 is shown filled with the fluid 26 in FIG. 1. The fluid may flow from the bottles through the conduit 72 toward the nozzle 38. Accordingly, the fluid 26 may be sprayed by the nozzle 38 over and/or across the distribution areas 36 by activation of the FES 112.

Referring to FIG. 2, the tractor 50 may be generally defined by a front end 52 that may be positioned opposite to the rear 18 of the trailer 10. The front end 52 may have a headlight 58 and a front wheel 60. The driver of the tractor 50 may enter into the cabin 54 using a step 62.

While driving the tractor 50 with the trailer 10, the driver may view the light 22 in a line of sight along the direction A as shown in FIG. 2. A fuel tank 64 may be positioned between the front end 52 of the tractor 50 and a first set of wheels 66 followed by a second set of wheels 68. During operation of the tractor 50, the front wheel 60 may drive the tractor 50 allowing for rotation of the first set of wheels 66. The second set of wheels 68, as shown in FIG. 2, may support the trailer 10 attached to the tractor 50 by the pin 30 as shown in FIG. 1.

Referring to FIG. 3, the tractor 50 attached to the trailer 10 by the pin 30 is shown. Like numerals refer to like elements as discussed for FIGS. 1-3, thus a redundant description of the same is omitted. The brake 40 may deteriorate to fail in a stuck position. Specifically friction between moving parts of the failed and/or stuck brake may cause the temperature, as detected by the wireless temperature sensor 44, to exceed a pre-set minimum threshold, thus triggering activation of the light 22 and/or the light 42 and/or communication from the WTMS 102 to the FES 112 to extinguish the fire 78 over the rear axle 74.

Further, the wheel 84 that may house the brake 40 may also become stuck, causing the tire 46 around the wheel 86 to drag along the pavement 90. The friction caused by the tire 46 rubbing against the pavement 90 may raise the temperature of the tire 46, the brake 40 and/or the rear axle 74. The temperature may rise to ignite the tire 46 and/or the brake 40 contributing to the spread of the fire around and/or across the rear axle 74.

Referring to FIG. 4, the tractor 50 attached to the trailer 10, which may, for example, be an oil tanker, by the pin 30 is shown. One of ordinary skill in the art will appreciate that the trailer 10 is not limited to a traditional trailer, or an oil tanker and may be, for example, a carrier such as that used to transport automobiles and/or any other type of trailer and/or carrier. Like numerals refer to like elements as discussed for FIGS. 1 and 3, thus a redundant description of the same is omitted. Similar to the trailer 10, as described in FIGS. 1 and 3, the oil tanker, as shown in FIG. 4, may have the brake 40 which may deteriorate to fail in a stuck position.

Accordingly, the wheel 84 that may house the brake 40 may also become stuck, causing the tire 46 around the wheel 84 to drag along the pavement 90. The friction caused by the tire 46 rubbing against the pavement 90 may raise the temperature of the tire 46, the brake 40 and/or the rear axle 74. The temperature may rise to ignite the tire 46 and/or the brake 40 contributing to the spread of the fire around and/or across the rear axle 74.

Figure 5:
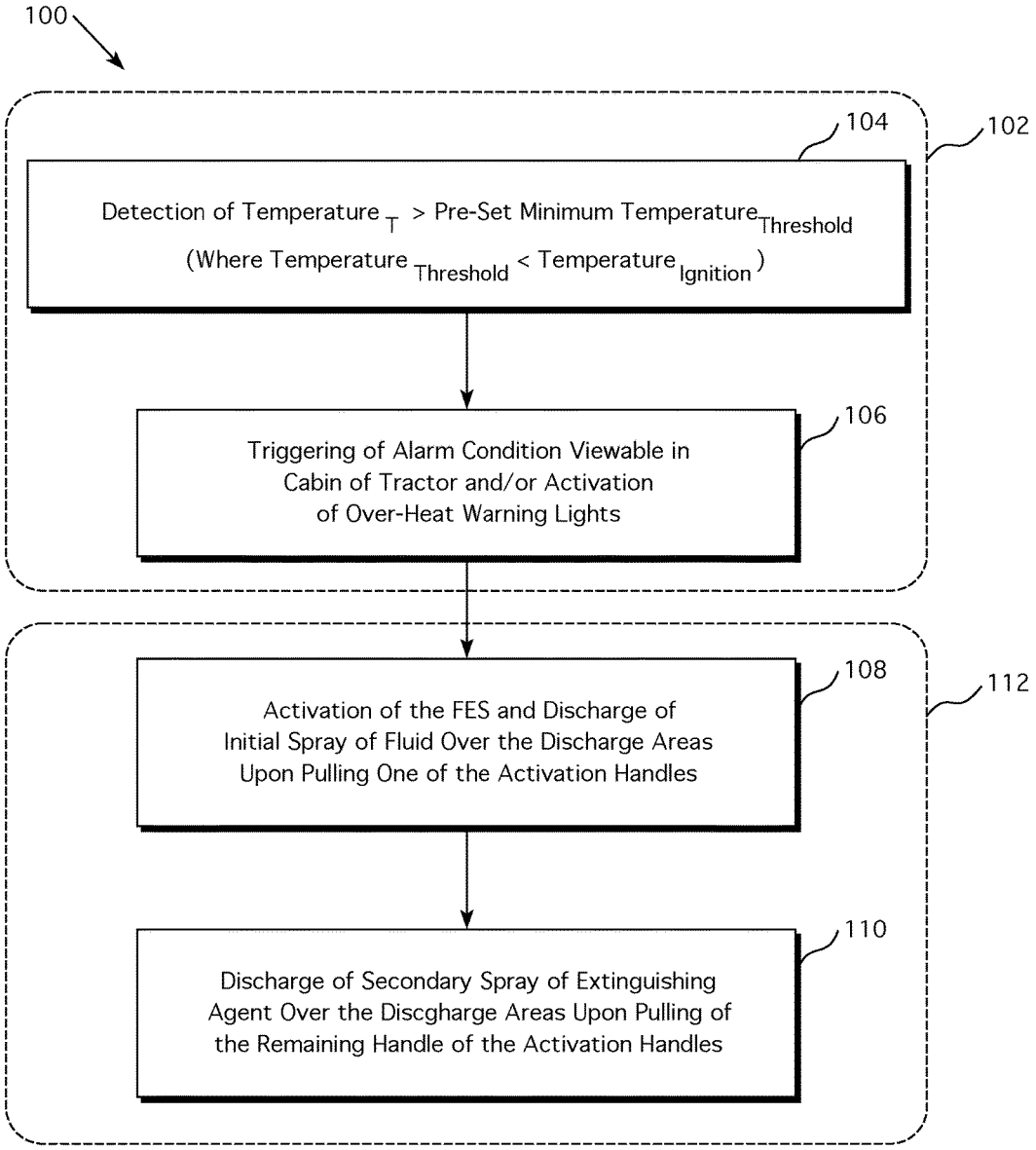
FIG. 5 illustrates a flow chart of fire detection and/or prevention systems in accordance with an embodiment of the invention.

Referring to FIG. 5, a flow chart of a system 100 having the WTMS 102 and the FES 112 is shown. At step 104, the WTMS 102 may electronically communicate with the wireless temperature monitor 44 to detect whether the temperature of any one or more of the brakes 40, the tire and/or the rear axle 74 may increase above a "Temperature Threshold," as shown in step 104. In an embodiment, the WTMS may detect and alert the driver of, for example, the temperature of the brakes 40 exceeding the "Temperature Threshold" which may correspond with a reduction in fuel efficiency of the truck 80, namely the tractor 50 pulling the trailer 10. At step 106, the trigger of an alarm condition, such as activation of the light 22 and/or the light 42, as shown in FIGS. 1, 3 and 4 may notify the driver of the fire 78 spreading over the rear axle 74 of the trailer 10. The driver of the tractor 50 pulling the trailer 10 may view the light 22 as shown in FIG. 3, to activate the FES 112 as set forth at step 108.

In an embodiment, the driver may pull one of the activation handles 24 to activate the FES 112 and initiate discharge of an initial spray of the fluid 26 over the distribution areas 36 to contain further spread of the fire over the rear axle 74 of the trailer 10, as shown in FIGS. 1, 3 and 4 as shown in FIG. 5. The driver may pull the remaining activation handle 24 at step 100 to discharge a second spray of the fluid 26 via the nozzles 38 to further contain and or extinguish the fire 78.

Alternatively, in an embodiment, step 104 may allow for a communication, such as via an electronic communication carried out by a "smart" phone and/or other electronic wireless device. Specifically, the WTMS 102 and/or the wireless temperature sensor 44 may electronically notify the fire department to arrive at the scene of the fire 78 at step 114 to bypass steps 104 through 110.

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

The invention claimed is:

1. An apparatus mounted on a trailer for extinguishing fire at a wheels and axles assembly of the trailer, apparatus comprising:

a discharge nozzle mounted on the trailer and configured to spray a fluid at the axles;

a temperature sensor positioned above and in between two set of wheels and axles assembly supporting the trailer, wherein the temperature sensor is configured to detect a temperature of a brake on the axles;

at least two warning lights mounted on a same side wall of the trailer, in a line of sight of a driver sitting in a truck cab pulling the trailer, and the at least two warning lights being positioned to be visible from a vehicle attached to and pulling the trailer, wherein the at least two warning lights are configured to activate in response to the temperature of the brake exceeding a threshold temperature;

a first activating handle mounted on a front portion of the side wall of the trailer, the handle configured to be pulled, wherein pull the activating handle causes the fluid to be supplied to the discharge nozzle; and a wireless temperature monitor configured to compare the detected temperature of the brake with the threshold temperature and activate the warning light when the detected temperature at the brake exceeds the threshold temperature, indicating a potential fire condition at the wheels and axles assembly.

2. The apparatus of claim 1, further comprising a bottle attached to the trailer and hold the fluid.

3. The apparatus of claim 1, further comprising a conduit configured to carry the fluid to the discharge nozzle.

4. The apparatus of claim 1, wherein the wireless temperature monitor is configured to compare the detected temperature with the threshold temperature to determine whether the detected temperature exceeds the threshold temperature, and notify a driver via activation of the warning light.

5. The apparatus of claim 1, wherein the at least two warning lights are positioned on the trailer so as to be viewable by a driver.

6. The apparatus of claim 2, wherein the bottle and the discharge nozzle are configured to be positioned beneath the trailer.

7. The apparatus of claim 1, wherein the discharge nozzle is configured to spray the fluid over a distribution area proportionately sized to encompass a fire over the axles.

8. The apparatus of claim 2, further comprising:

a second bottle attached to a different side wall of the trailer and holding additional fluid; and a second handle mounted adjacent the first activating handle on the trailer and operable to be pulled, wherein pulling the second handle causes the fluid to be supplied from the second bottle to the discharge nozzle.

9. The apparatus of claim 2, wherein the bottle contains a fire retardant fluid.

10. The apparatus of claim 1, wherein the temperature sensor is further configured to detect a temperature of a wheel bearing or tire of the wheels and axle assembly.

* * * * *